United States Patent [19]

Shaw

[11] Patent Number: 4,557,283

[45] Date of Patent: Dec. 10, 1985

[54] DISHWASHER

[76] Inventor: John B. Shaw, 4425 Gateway Dr., Monroeville, Pa. 15146

[21] Appl. No.: 602,804

[22] Filed: Apr. 23, 1984

[51] Int. Cl.[4] ..... B08B 3/02

[52] U.S. Cl. ..... 134/177; 134/179

[58] Field of Search ..... 134/179, 59, 174–177

[56] References Cited

U.S. PATENT DOCUMENTS

| | | | |
|---|---|---|---|
| 1,681,322 | 8/1928 | Cave | 134/176 X |
| 1,833,374 | 11/1931 | Renshaw | 134/179 X |
| 3,446,219 | 5/1969 | Hilleman | 134/179 X |
| 3,469,586 | 9/1969 | Berson et al. | 134/179 X |
| 3,773,060 | 11/1973 | Byrd | 134/179 |
| 4,135,532 | 1/1979 | Rutherford | 134/179 X |
| 4,420,005 | 12/1983 | Armstrong | 134/179 X |

FOREIGN PATENT DOCUMENTS

| | | | |
|---|---|---|---|
| 1562039 | 2/1969 | France | 134/179 |
| 104057 | 3/1924 | Switzerland | 134/179 |

*Primary Examiner*—Philip R. Coe

*Attorney, Agent, or Firm*—Thomas H. Murray; Clifford A. Poff

[57] ABSTRACT

A portable, countertop dishwasher having a washing media dispensing nozzle structure which includes radially-projecting, washing media-dispensing arms and an improved unitary dish rack located in surrounding relationship with the axis of the nozzle structure and axially intermediate upper and lower nozzle structure pivot supports, the unitary dish rack including support structures for supporting articles to be washed within the radial sweep of the radially projecting arms of the nozzle structure and being selectively removable from the dishwasher independently of the nozzle structure.

10 Claims, 5 Drawing Figures

DISHWASHER

BACKGROUND OF THE INVENTION

This invention relates to dishwashers and, more particularly, to dishwashers having an improved rack and improved washing-water dispersion nozzles therein. It is known in the art of dishwashers to provide a water-powered countertop dishwasher wherein the dishes remain stationary and the washing media is supplied to a horizontally-rotatable hollow arm provided with spray nozzles or apertures which are oriented to project water from the arm onto the dishes and wherein the spray apertures are also directed so that the emission of water therefrom provides a turning moment which causes the arm to rotate.

Such dishwashers typically have been of lightweight and portable design and have been adapted to wash only a relatively small quantity of tableware as the dish rack is usually of very limited capacity. Prior art examples of such dishwashers include those disclosed in U.S. Pat. Nos. 4,420,005, 4,135,532 and 3,773,060.

Prior such dishwashers have been of very limited size, for the sake of convenient portability, and this size limitation has had a direct impact upon cleaning capability for two primary reasons. First, the interior space limitations directly impact the availability of adequate space between the dishes for effective washing. Second, rotary nozzle systems are provided which disperse a water and detergent mix within the dishwasher, and the size limitations of the dishwasher as well as typical water pressure limitations directly impact the size and design of the rotary nozzle system. Thus, without unduly limiting the dish capacity of the dishwasher, practitioners have constantly sought improved dish racks and improved rotary nozzle systems to optimize the washing process.

The present invention relates to an improved dishwasher of the type specified which includes an improved dish rack and improved washing media dispersion nozzles. More specifically, the present invention provides for an improved, unitary dish rack for carrying dishes and cups or glasses as well as a basket for silverware in a compact and yet effective arrangement for washing by an improved; nozzle system having horizontal nozzle arms. The nozzle arms are carried by an upstanding rotary spindle which is pivotally supported adjacent both of its axial ends for axial rotation to thereby rotate the arms horizontally.

The dish rack of this invention cooperates with the nozzle system such that, although it is constructed to surround the nozzle system intermediate the rotationally supported ends of the nozzle system, the dish rack is nevertheless removable from the dishwasher without disassembly of the nozzle system therefrom.

Accordingly, it is one general object of this invention to provide a novel and improved portable, water-powered dishwasher.

Another more specific object of the invention is to provide a novel and improved dish rack for such portable dishwasher.

Yet another object of the invention is to provide a novel and improved washing media nozzle system and novel support for same.

These and other objects of the invention will be more readily understood upon consideration of the following detailed description and the accompanying drawings, in which.

Figure 1:
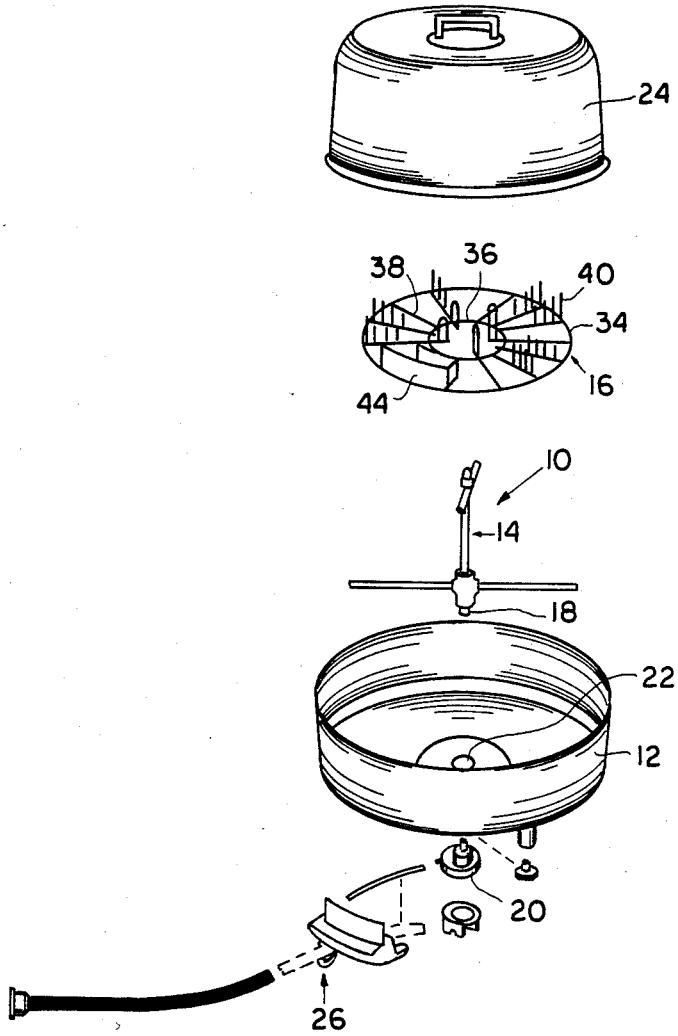
FIG. 1 is an exploded perspective view of the dishwasher of the present invention.

There is generally indicated at 10 in FIG. 1 a dishwasher constructed according to one presently-preferred embodiment of the instant invention. The dishwasher 10 comprises a molded plastic body member of drum 12 within which a nozzle structure 14 and a dish rack 16 are carried. The lower end 18 of nozzle structure 14 is rotatably mounted in a rotary fitting 20 which is secured to the bottom of drum 12 and projects thereinto through a centrally-located bottom opening 22 to receive the end 18 of nozzle structure 14.

A transparent, molded plastic cover 24 fits atop drum 12 to thereby enclose dish rack 16 and nozzle structure 14 within a closed space encompassed by the assembled cover 24 and drum 12. A suitable assembly of connections and conduits, generally indicated at 26, is provided to connect rotary fitting 20 to any suitable source of water and to provide a water and detergent mix for the washing process.

The dishwasher elemets and their assembly as described hereinabove are well known in the art and form no part of the instant invention. Accordingly, further detailed description thereof is believed to be unnecessary. Reference is made thereby to the above-mentioned patents, and particularly to U.S. Pat. No. 3,773,060, for further detailed description of the overall structure of a portable dishwasher.

Figure 2:
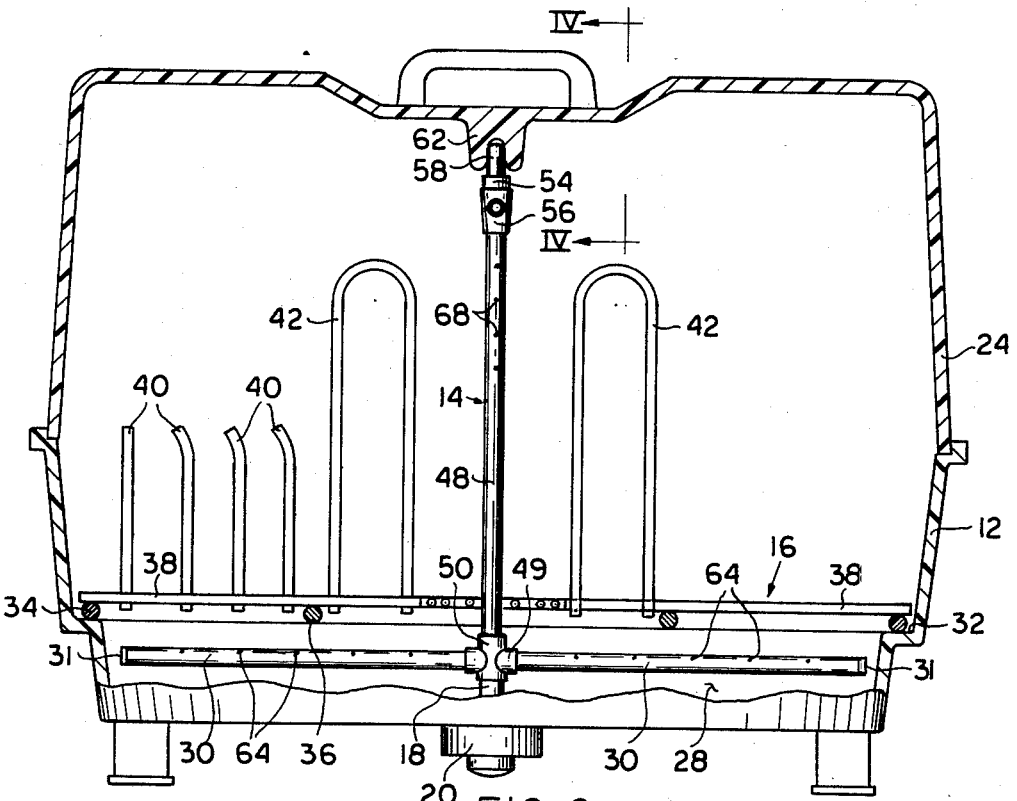
FIG. 2 is a sectioned side elevation of the assembled dishwasher of FIG. 1 and showing the dish rack generally from line II—II of FIG. 3.
Figure 4:
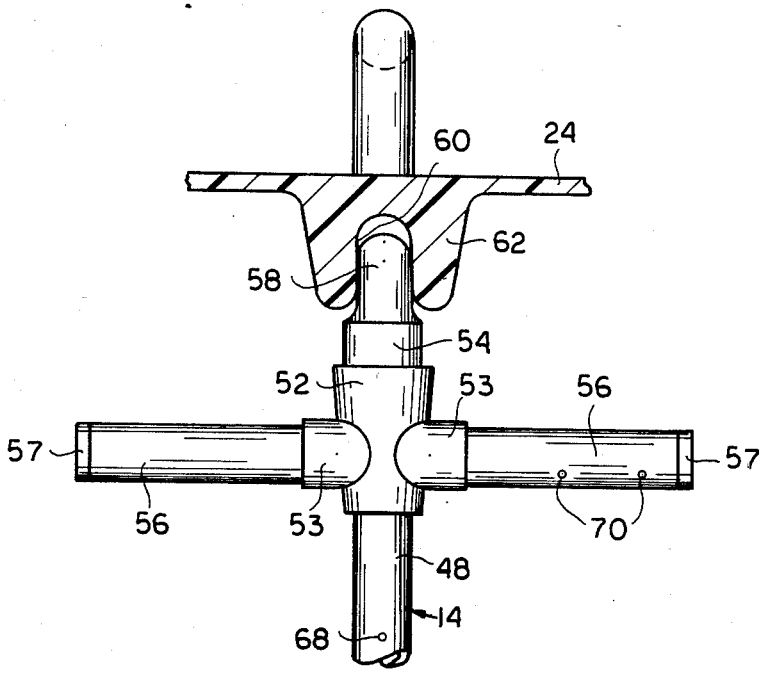
FIG. 4 is a partially-sectioned, fragmentary side elevation of the nozzle structure pivot taken on line IV—IV of FIG. 2.

Referring to FIGS. 1, 2 and 4, the drum or body 12 includes a lower well portion 28. Dish rack 16 is supported above lower arm portion 30 upon an annular shoulder 32 formed within drum 12. Dish rack 16 preferably comprises a welded wire structure which may be plastic coated or otherwise adapted to protect articles carried thereby from scratching, and includes coaxial outer and inner rings 34, 36 which are connected together by a plurality of circumferentially-spaced, radially-extending wire elements 38 welded thereto.

Selected ones of the radial elements 38 include a plurality of upstanding dish supports 40 welded thereto at radially-spaced locations intermediate inner and outer rings 36, 34. Supports 40 preferably are angled radially outward adjacent their upper ends to provide suitable dish support. Some of the radial elements 38 include an upstanding tang 42 secured thereto preferably at a location radially inward of inner ring 36. Each tang 42 is generally of an inverted U-shaped configuration having the free ends of its legs welded to the respective radial elements 38.

Figure 3:
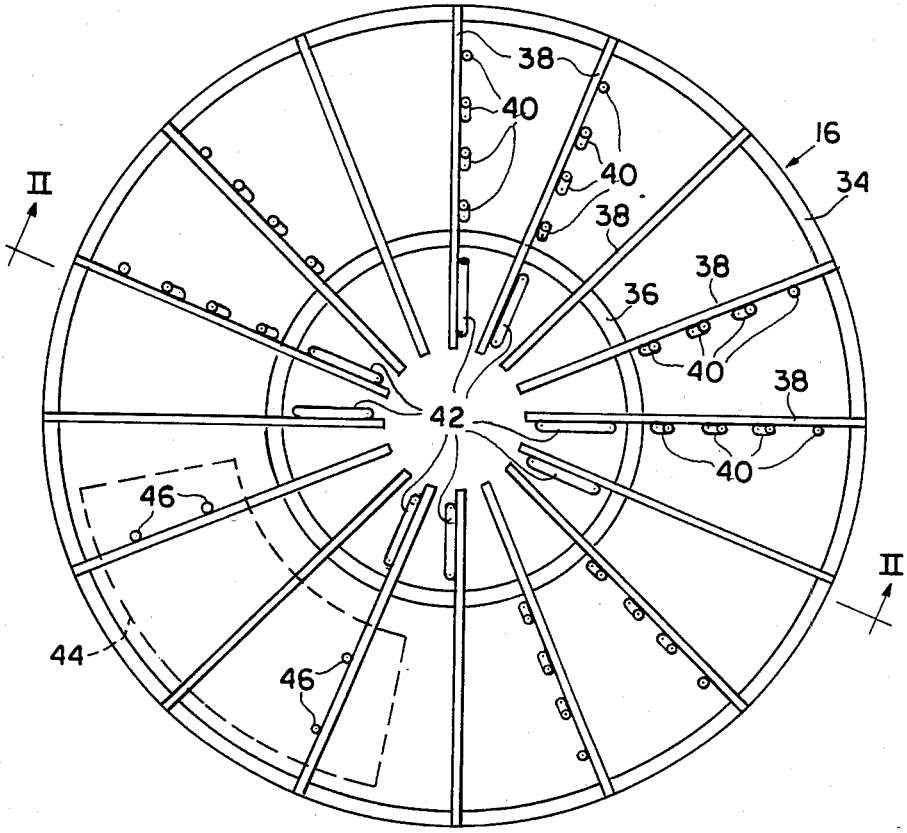
FIG. 3 is a generally schematic plan view of the dish rack of the invention.

Several circumferentially-adjacent ones of radial elements 38 which do not have dish supports 40 provide clearance for a silverware basket 44 (FIG. 1) which is retained in place by upstanding prongs 46 (FIG. 3) affixed to the respective radial elements 38 underlying basket 44. It is to be appreciated that the representation of dish rack 16 in FIG. 2 is simplified for purposes of illustrative clarity to show only certain elements thereof. The described dish rack elements are located in a suitable pattern such as depicted in FIG. 3 whereby the various articles to be carried by the dish rack 16 are suitably positioned for washing by media dispersed from nozzle structure 14.

Referring to FIGS. 2 and 4, nozzle structure 14 may preferably include an upstanding, tubular, rotary spindle portion 48, the lower end of which is connected to a molded tee 50. The lower end portion 18 of nozzle structure 14 is also connected to tee 50 in axial alignment with spindle portion 48. Tubular media dispersing arms 30 are connected to side branches 49 of tee 50 and project laterally therefrom beneath dish rack 16. The radially outer ends of arms 30 are capped with caps 31. Another molded tee 52 is connected to the upper end of spindle portion 48 and an upper end stub 54 is also connected to tee 52 and projects upwardly therefrom in axial alignment with spindle portion 48.

Tubular upper arms 56 are connected to side branches 53 of tee 52 so as to project laterally therefrom, preferably at a 90° angle to the lower arms 30. The radially outer ends of arms 56 are capped with caps 57. A pivot member 58 extends upwardly from the top of stub end 54 and is rotatably received within a downwardly open recess 60 formed in a depending pivot member 62 located centrally of cover 24 to provide pivotal support for the upper end of nozzle structure 14.

Figure 5:
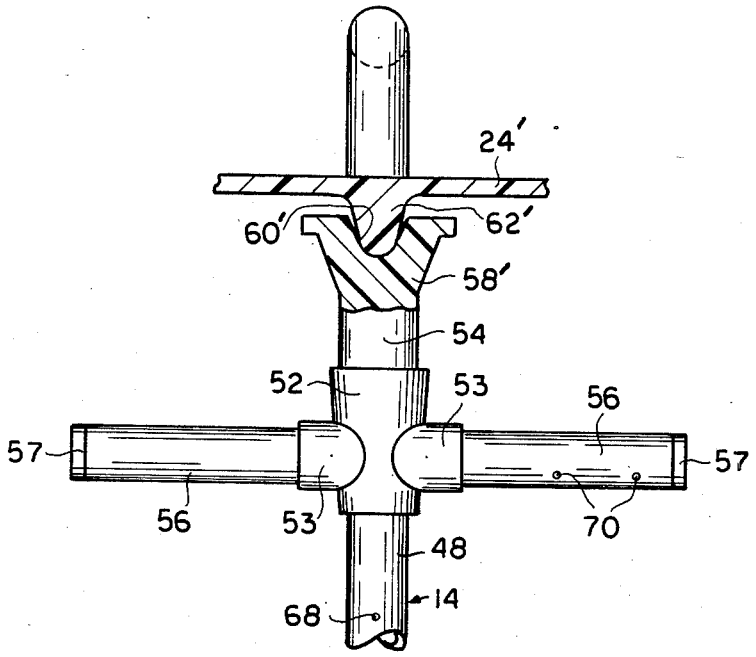
FIG. 5 is a partially-sectioned, fragmentary side elevation similar to FIG. 4 and showing an alternative pivot structure.

An alternative structure for pivotal support of the upper end of nozzle structure 14 is shown in FIG. 5 as having a plug member 58' formed with an upwardly opening recess 60' into which is received a depending pivot member 62' which is located centrally of cover 24' and is integral therewith. All other details of the upper end portion of nozzle structure 14 of FIG. 5 are substantially the same as described with reference to FIG. 4.

The nozzle structure 14 includes a number of nozzles or orifices for dispersing washing media within the dishwasher. Each of lower arms 30 includes a plurality of nozzles 64 which directs washing media upward onto the articles carried by rack 16 and into glasses or cups which are inverted on tanges 42.

Spindle portion 48 includes a plurality of axially-spaced nozzles 68 which disperse washing media radially outward onto the artilces carried by the dish rack 16.

Each of the upper arms 56 includes a plurality of nozzles 70 which directs washing media downwardly onto the articles carried by dish rack 16. The downward orientation of nozzles 70 provides an increment of upward thrust upon nozzle structure 14 to counterbalance the thrust load induced by media dispersion from nozzles 64. Additionally, the nozzles 64 and 70 are oriented at an angle to vertical, preferably an angle of approximately 30° to provide respective force couples that impart a rotary impetus to rotate nozzle structure 14.

The above-described arrangement of nozzles provides an improved washing action for articles carried in the dish rack by virtue of the radial, upward and downward jets of media. Furthermore, as upper arms 56 are positioned at 90° to lower arms 30, the rotation of nozzle structure 14 produces a unique washing action on any given article comprised of alternating upward and downward directed media flow and periodic laterally-directed media flow. Notwithstanding the description of this particular nozzle configuration, it will be appreciated that alternative nozzle structures are contemplated, including structures with coplanar upper and lower media dispersing arms, or with upper and lower arms oriented at an angle other than 90° to each other. Furthermore, for purposes of this invention, the nozzle structure may alternatively include an upper arm portion only, or a lower arm portion only.

For the embodiment described, it is to be noted that upper arms 56 are contained entirely within the diameter of inner ring 36 of dish rack 16. Furthermore, the minimum circumferential clearance between adjacent radial elements 38 where they extend radially inward of ring 36 is sufficient to allow arms 56 to pass therebetween. Accordingly, the dish rack 16 may be readily removed from the dishwasher without disassembly of nozzle structure 14, even though the disk rack is able, by virtue of tangs 42 and radial elements 38, to carry articles within the radial extent of upper nozzle arms 56, and even though the dish rack surrounds a structure which is pivotally supported at both ends in operation.

According to the description hereinabove, the present invention provides a novel and improved potable, water-pressure powered dishwasher. The above description represents the presently-preferred embodiment of the invention. As various alternatives and modified embodiments have been contemplated, it is intended that the invention be construed broadly and limited only by the scope of the claims appended hereto.

I claim as my invention:

1. In a portable, water-pressure powered dishwasher, the combination comprising:

a nozzle structure rotably supported at each of opposite ends thereof within the dishwasher for rotation about a substantially vertical axis, a unitary dish rack adapted to be supported within the dishwasher in surrounding relationship with said vertical axis intermediate the axial ends of said nozzle structure, said nozzle structure comprising an upstanding tubular spindle portion having a tee connected in fluid communication with the upper end thereof, a pair of tubular media dispensing lower arms extending radially outward in opposite directions from the lower portion, a pair of tubular media dispensing upper arms joined to extend radially in opposite directions from said tee in fluid communication with said tubular spindle portion, a fluid impervious stub connected to said tee to extend vertically in a coaxial relation with said vertical axis, an upper end portion of said stub forming a first rotary bearing surface, and means for rotably supporting a lower end portion of said upstanding tubular spindle portion, said dish rack including radially extending elements connecting inner and outer rings for supporting articles to be washed within the radially outer extent of said upper arms, said radially extending elements projecting within the radially outermost sweep of said upper arms from said inner ring which is outside the outermost sweep of the upper arms to form vertical pathways between the radially extending elements for said upper arms during replacement of the dish rack with the nozzle structure in situ, and a removable cover for the dishwasher which encloses said nozzle structure and said dish rack within the dishwasher, said cover including a second rotary bearing surface cooperable with said first rotary surface to rotatively support an upper end portion of said nozzle structure when said cover is in place on the dishwasher.

2. The combination as claimed in claim 1 wherein said upper and lower arms include media-dispersing orifice means for dispersing washing media under pressure respectively downwardly and upwardly onto articles carried by said dish rack.

3. The combination as claimed in claim 2 wherein at least some of said media-dispersing orifice means are oriented such that the dispersion therefrom of washing media under pressure imparts a rotary impetus to said nozzle structure.

4. The combination as claimed in claim 3 wherein at least some of said media-dispersing orifice means in both said upper and said lower arms are oriented such that the dispersion therefrom of washing media under pressure imparts a rotary impetus to said nozzle structure.

5. The combination as claimed in claim 1 wherein said upper arms are substantially perpendicular to said lower arms.

6. In a portable countertop dishwasher having a rotatably washing media dispensing nozzle structure which includes an elongated spindle portion which is rotatably supported adjacent its opposite axial ends and elongated arms extending radially from opposite ends of an upper end of said spindle portion, and a unitary dish rack adapted to be carried within the dishwasher in surrounding relationship with the spindle portion and intermediate the axial ends of the spindle portion, the combination therewith comprising:

said dish rack including a ring having a diameter larger than the length of said elongated arms, radially extending members having terminal end portions projecting toward said elongated spindle portion when the dish rack is carried within the dishwasher, said radially extending members carried by said ring and forming gaps therebetween for supporting articles to be washed within the radial extent of the shortest of said radially-extending arms, said dish rack being selectively removable from the dishwasher independently of the nozzle structure by passage of said elongated arms in the gaps between the terminal and portions of said radially extending members.

7. The improvement as claimed in claim 6 wherein said dish rack is selectively removable axially of said nozzle structure for said removal thereof independently of the nozzle structure.

8. In a portable countertop dishwasher having an upwardly-open base member with a rotary nozzle structure located centrally thereof which includes radially-extending washing media dispensing arms on the upper portion of the nozzle structure and wherein a unitary dish rack is carried by said base member in surrounding relationship with the axis of said nozzle structure and beneath the elevation of said media dispensing arms and is selectively removable from said dishwasher independently of said nozzle structure, said dish rack comprising:

an outer ring means, an inner ring means coaxial with said outer ring, radially-extending elements connecting said inner and outer rings to form a substantially planar dish rack base, the radially inner ends of said radially-extending elements forming gaps therebetween, the gaps extending to the inner ring within the radially outermost sweep of said arm portions whereby, article-supporting means connected to said base and projecting upwardly thereof, and at least some of said article-supporting means being located within the radially outermot sweep of said arms whereby said dish rack can be installed in said base members by passage of media dispensing arms through said gaps.

9. The dish rack as claimed in claim 8 wherein said article-supporting means includes inverted U-shaped tangs affixed to said radially inner ends of at least some of said radially extending elements.

10. The dish rack as claimed in claim 9 wherein some of said article supporting means include upwardly projecting prongs having radially outwardly angled upper end portions.

* * * * *